US010676111B2

(12) United States Patent
Karner et al.

(10) Patent No.: US 10,676,111 B2
(45) Date of Patent: Jun. 9, 2020

(54) DEVICE FOR FORCE TRANSFER BETWEEN CHASSIS FRAME AND CARRIAGE BODY OF A RAIL VEHICLE

(71) Applicant: Siemens AG Österreich, Vienna (AT)

(72) Inventors: Christian Karner, Ilz (AT); Radovan Seifried, Maribor (SI); Thomas Willidal, Stattegg (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 309 days.

(21) Appl. No.: 15/551,639

(22) PCT Filed: Feb. 11, 2016

(86) PCT No.: PCT/EP2016/052937
§ 371 (c)(1),
(2) Date: Aug. 17, 2017

(87) PCT Pub. No.: WO2016/131707
PCT Pub. Date: Aug. 25, 2016

(65) Prior Publication Data

US 2018/0065648 A1 Mar. 8, 2018

(30) Foreign Application Priority Data

Feb. 18, 2015 (AT) ..... A 50123/2015

(51) Int. Cl.
*B61F 5/16* (2006.01)
*B61F 5/22* (2006.01)
*B61F 5/24* (2006.01)

(52) U.S. Cl.
CPC ..... *B61F 5/16* (2013.01); *B61F 5/22* (2013.01); *B61F 5/24* (2013.01)

(58) Field of Classification Search
CPC ..... B61F 5/00; B61F 5/02; B61F 5/04; B61F 5/08; B61F 5/10; B61F 5/12; B61F 5/16
See application file for complete search history.

(56) References Cited

U.S. PATENT DOCUMENTS 3,884,157 A * 5/1975 Pelabon ..... B61F 3/08 105/199.3
4,134,343 A 1/1979 Jackson
4,357,879 A 11/1982 Mohacsi et al.

FOREIGN PATENT DOCUMENTS

CA 1148029 A1 * 6/1983 ..... B61F 5/10
CN 200960931 10/2007
CN 201070994 6/2008

(Continued)

*Primary Examiner* — Robert J McCarry, Jr.
(74) *Attorney, Agent, or Firm* — Cozen O'Connor

(57) ABSTRACT

A device for force transfer between a chassis frame and a carriage body of a rail vehicle includes a plurality of lemniscate links which are connected to the chassis frame via first joints, a yoke having a middle linking point in which the carriage body can be mounted, wherein the plurality of lemniscate links are connected to the yoke via second joints and form a Z-shaped assembly, where elastically deformable elements are arranged in the in the yoke and the first and second joints, and includes limiting means for receiving impact loads that exceed the operating load so as to limit the maximum deflection of the middle linking point of the yoke in a tractive force direction parallel to a tractive force acting on the chassis frame.

19 Claims, 1 Drawing Sheet

(56) References Cited

FOREIGN PATENT DOCUMENTS

| | | | |
|---|---|---|---|
| CN | 202783228 | U | 3/2013 |
| CN | 203358608 | U | 12/2013 |
| CN | 104245472 | | 12/2014 |
| DE | 2259128 | | 6/1974 |
| DE | 20112340 | | 12/2002 |
| EP | 1254821 | | 11/2002 |
| FR | 2442167 | | 6/1980 |
| GB | 1368252 | | 9/1974 |
| RU | 2267424 | | 1/2006 |
| RU | 2294293 | | 2/2007 |
| SU | 1024333 | | 6/1983 |
| SU | 1050943 | | 10/1983 |
| WO | WO 96/33898 | | 10/1996 |
| WO | WO 2013/160079 | | 10/2013 |

* cited by examiner

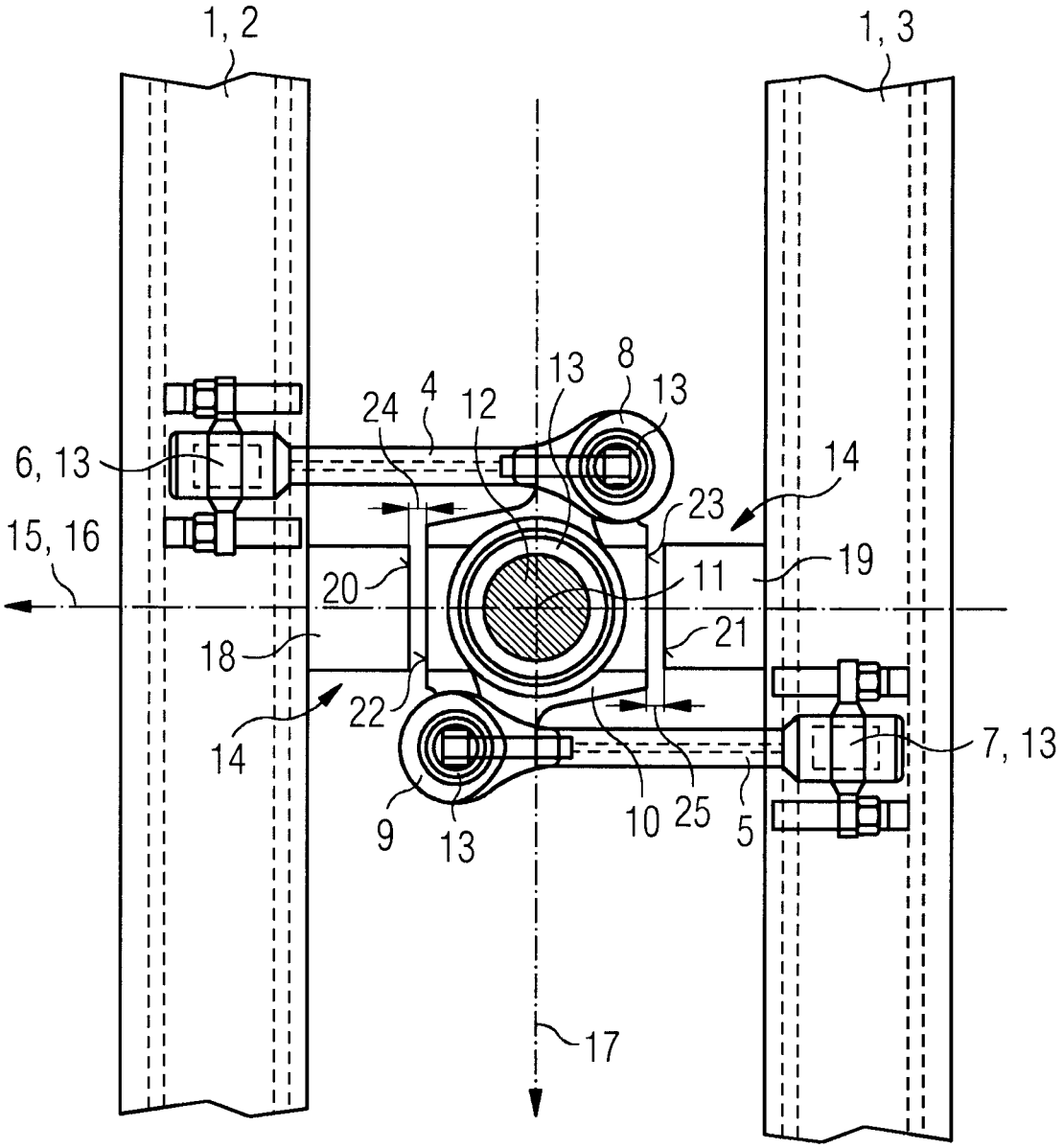
1, 2
1, 3
6, 13
15, 16
24
4
12
13
8
13
14
23
19
20
11
21
18
22
14
7, 13
9
13
10
25
5
17

DEVICE FOR FORCE TRANSFER BETWEEN CHASSIS FRAME AND CARRIAGE BODY OF A RAIL VEHICLE

CROSS-REFERENCE TO RELATED APPLICATIONS

This is a U.S. national stage of application No. PCT/EP2016/052937 filed 11 Feb. 2016. Priority is claimed on Austrian application No. A50123/2015 filed Feb. 18, 2015, the content of which is incorporated herein by reference in its entirety.

BACKGROUND OF THE INVENTION

1. Field of the Invention

The invention relates to a device for force transfer between a chassis frame and a carriage body of a rail vehicle with a plurality of lemniscate links that are connected to the chassis frame via first joints, a yoke with a middle linking point in which a pivot pin of the carriage body is mountable, where the plurality of lemniscate links are connected to the yoke via second joints and form a Z-shaped assembly and where elastically deformable elements are arranged in the first and second joints and in the yoke.

2. Description of the Related Art

As a rule, chassis, also called bogies, of rail vehicles have two wheel sets that are guided on rails and connected to carriage bodies of the rail vehicle. An essential component of a chassis is a chassis frame to which are connected the wheel sets, for example, via a wheel set guide or a primary suspension, the carriage body, for example, via a secondary suspension, and a device for force transfer. Here, the flows of forces between the individual components primarily pass through the chassis frame, which has a longitudinal direction and a transverse direction, where the longitudinal direction points in the direction of travel of the rail vehicle and the transverse direction is normal to the longitudinal direction.

Typically, the devices used for force transfer are plunger spigots or lemniscate links, where the present invention relates to such lemniscate links. Lemniscate links are characterized in that substantially three rods are interconnected in an articulated manner and the two external rods are mounted on a fixed point, with the three rods forming a Z-shaped assembly. Specifically, the two external rods are two lemniscate links that are each mounted on a fixed point in the chassis frame via first joints. The inner rod is formed by a yoke in which, in the operating state, a pivot pin of the carriage body is mounted in a middle linking point and which is connected to the lemniscate links via second joints.

If, during operation, the carriage body is now deflected in the transverse direction or loaded by a transverse force, then the second joints of the lemniscate links move on a circularly arcuate path about the first joints so that the middle linking point and, hence, the pivot pin are displaced approximately parallel to the transverse direction with respect to the chassis frame. It is self-evident, that in this case, the Z-shaped assembly changes such that the two lemniscate links are no longer parallel to one another.

A tractive force resulting from the movement of the rail vehicle and acting on the chassis frame is transferred via the lemniscate links and the yoke between the carriage body and the chassis frame. Here, when traveling in a straight line, a tractive force direction of the tractive force corresponds to the longitudinal direction of the chassis frame, but can, such as when cornering, deviate therefrom in a range of approximately +/−30°.

In order to be able to absorb and cushion impact loads in the tractive force direction under the operating load, such as when accelerating or braking, the joints and yoke comprise elastically deformable elements, such as rubber bushings. However, because in exceptional situations, such as buffer impacts, in which the rail vehicle approaches a stationary object, extremely high loads occur in the tractive force direction, both lemniscate links and the elastic elements have to be greatly over-dimensioned in order to prevent failure. This results, on the one hand, to increased weight due to the bulky design of the lemniscate links or the yoke and, on the other, to impaired riding comfort because the elastic elements are extremely rigid and hence damping of the impacts that occur during operation is reduced.

SUMMARY OF THE INVENTION

In view of the foregoing, it is therefore an object of the invention to provide a device for force transfer between a chassis frame and a carriage body of a rail vehicle in which the elements of the device can be configured for the operating load to achieve a weight reduction and greater riding comfort so as to overcome the drawbacks of the prior art.

This and other objects and advantages are achieved in accordance with the invention by a device for force transfer between a chassis frame and a carriage body of a rail vehicle with a plurality of lemniscate links which are connected to the chassis frame via first joints, a yoke with a middle linking point in which a pivot pin of the carriage body is mountable, where the lemniscate links are connected to the yoke via second joints and form a Z-shaped assembly and where elastically deformable elements are arranged in the joints and yoke.

In accordance with the invention, limiting means are provided to limit the maximum deflection of the middle linking point of the yoke in a tractive force direction parallel to a tractive force acting on the chassis frame. If the chassis frame is loaded in the tractive force direction, then the elastic elements in the joints are elastically deformed as are the lemniscate links such that the total of the deformation paths of the individual elements of the middle linking point, and hence also the pivot pin that is mountable therein, are displaced in the tractive force direction. Therefore, the limiting means ensure that the middle linking point can no longer be arbitrarily displaced in the tractive force direction. Possible limiting means are, for example, stops, rails, guide sleeves or transverse guides that prevent further deformation of the elastic elements, for example, in that the yoke or the pivot pin themselves come into contact with the limiting means. In particular, in the case of impact loads, such as buffer impacts, instead of being reduced by the deformation of the elastic elements and the lemniscate links, some of the forces that occur are introduced directly into the chassis frame. In other words, a device in accordance with the invention is suitable for absorbing impact loads exceeding the operating load. This enables the elastic elements and the plurality of lemniscate links to be configured for the operating state so that they can have smaller dimensions and hence reduced weight and improved riding comfort is achieved.

In an embodiment of the invention, the first joints of the plurality of lemniscate links are each attached to a cross arm of the chassis frame and the limiting means are formed as a first emergency stop and second emergency stop, which are arranged on the cross arms. Therefore, this embodiment relates to a chassis frame with two parallel cross arms extending parallel to a transverse direction. Herein, the cross arms offer an extremely simple structural option for introducing forces directly into the chassis frame and therefore the first joints are connected to the cross arms and the emergency stops are arranged thereon. An emergency stop should be understood to mean all elements suitable for absorbing a part of the forces that occur on impact loads and, therefore, these have to be approximately rigid, i.e., substantially rigid in the tractive force direction by at least one order of magnitude greater than the rigidity of the elastic elements.

In a further embodiment of a device for force transfer in accordance with the invention, the yoke is arranged between the two cross arms, preferably symmetrically in a longitudinal direction and/or a transverse direction. Here, the assembly between the two cross arms enables uniform distribution of the forces both in the longitudinal direction, corresponding to a direction of travel of the rail vehicle, and counter to the longitudinal direction when the drive of the rail vehicle is arranged on the other side of the chassis frame. The centering in both the longitudinal direction and the transverse direction achieves smooth mounting of the carriage body due to uniform swiveling-out thereof during operation corresponding to a high level of ride comfort.

In order, for example, to retrofit existing chassis frames with a device for force transfer according to the invention, i.e., a plurality of lemniscate links and a yoke, in a simple manner, in a further embodiment of the invention the emergency stops are connected to the cross arms. Here, for example, the emergency stops can be jaws, cases, boxes, consoles or blocks connected to the cross arms either in a non-positive manner via screws, rivets or clamps or in a positive manner via welded seams.

However, if the cross arms are specifically constructed for the device for force transfer in accordance with the invention, in an alternative embodiment the emergency stops are formed by the cross arms because this can save additional weight. Here, for example, the emergency stops are formed as protruding segments or console-type segments extending from the cross arms in the direction of the middle linking point. On the other hand, it is also conceivable for the cross arm to be U-shaped or I-shaped and for the horizontal segments of the cross arms facing the middle linking point to form the emergency stops. To increase rigidity further, it is furthermore possible for reinforcing plates or ribs to be provided in the region of the emergency stops.

In one preferred embodiment, the first emergency stop comprises a first stop surface for a first contact surface of the yoke and that the second emergency stop comprises a second stop surface for a second contact surface of the yoke. The stop surfaces that come into contact with the contact surfaces of the yoke on an impact load is a simple way of limiting the movement of the middle linking point in the tractive force direction in that the movement of the yoke with the middle stopping point is prevented. Here, the stop surfaces should be provided according to the surface pressure that occurs, where an enlargement of the stop surfaces always causes a reduction in the surface pressure that occurs.

Although, theoretically, both stop surfaces can each be attached offset to one another at different points of the cross arms, for example, in the vertical direction, normal to the longitudinal direction and to the transverse direction, it has been found to be particularly advantageous for the first stop surface and the second stop surface to lie opposite to one another and the yoke to be arranged in a longitudinal direction in the middle between the stop surfaces. Arranging the yoke in the middle enables the chassis frame to be used with such an embodiment of a device for force transfer in both directions of travel. The symmetrical positioning also contributes to a simple chassis frame construction.

In a further preferred embodiment of the invention, the yoke comprises a first contact surface and a second contact surface, where the contact surfaces face the respective stop surfaces. Here, it is possible for the contact surfaces of the yoke to be formed by the, for example, cylindrical, jacket surface of the yoke itself or for the jacket surface of the yoke to have a special shape, for example, to form flat or curved segments extending in the direction of the connecting surface and accordingly forming the contact surfaces. Herein, it is self-evident that both the contact surfaces and the stop surfaces can be provided with a damping layer, such as rubber, in order to reduce wear on the surfaces. Here, the layer should be thin enough to ensure that they only exert a little influence on the rigidity of the emergency stops or the yoke.

In accordance with a further preferred embodiment, the contact surfaces and/or the stop surfaces are formed flat. This enables a particularly simple configuration and dimensioning of the emergency stops or configuration of the jacket surface of the yoke because flat surfaces are simple to produce. In particular, when the tractive force direction is aligned parallel to the longitudinal direction on an impact load, this enables the surface pressure to be minimized since very large contact surfaces or stop surfaces are possible.

However, because impact loads can also occur when the tractive force direction is not aligned parallel to the longitudinal direction so that two flat surfaces would eat into one another at an edge, in one further preferred embodiment of a device for tractive force transfer in accordance with the invention the contact surfaces and/or the stop surfaces are formed in a bent shape, preferably in a cylinder-jacket shape. As a result, in the case of contact between one of the stop surfaces and one of the contact surfaces, a convex surface always impinges on a flat surface or a convex surface always impinges on a concave surface thus to a large extent avoiding damage to the emergency stops or the yoke and hence extending the lifetime of the device.

In a particularly preferred embodiment of the invention, the contact surfaces and the stop surfaces are spaced apart from one another. The fact that the stop surfaces and the contact surfaces are spaced apart from one another ensures that, on the one hand, the swivel motion of the lemniscate links about the axes the first joints is not impeded thus enabling movement of the middle linking point parallel to the transverse direction and that, on the other hand, the contact surfaces and the stop surfaces are only in contact in the event of an impact load, while impacts that occur under a normal operating load are still absorbed or damped by the elastic elements.

Therefore, in a further particularly preferred embodiment a first distance is established between the first stop surface and the first contact surface and/or a second distance is established between the second stop surface and the second contact surface, where the first distance and/or the second distance corresponds at least to the deformation path of whichever elastic element has the least rigidity under an operating load. The elastic elements no longer have to be over-dimensioned in order to be able to absorb impact loads. As a result, their rigidity is lower. In order to dimension the distances correctly, i.e., to ensure that under the operating load, the stop surfaces are not in contact with the contact surfaces, it is necessary for all elastic deformations in both the elastic elements and the plurality of lemniscate links themselves or the deformation path thereof to be taken into account under the maximal permissible operating load.

Herein, if one of the elastic elements has lower rigidity than the other, thus resulting in greater deformations, then this deformation path can be used as a guide value for the minimum distances required. Hence, if all elastic elements are equally rigid, then it is, for example, possible to use a mean value or an empirical value. As the result of extensive exemplary calculations and models, a range was determined for the distances of between 2 mm and 20 mm, preferably between 3 mm and 10 mm, in particular between 4 mm and 8 mm.

In accordance with a further preferred embodiment of a device for force transfer in accordance with the invention, on an impact load in the tractive force direction that is higher than the operating load, the elastic elements in the joints or in the yoke elastically are elastically deformed such that either the first contact surface contacts the first stop surface or the second contact surface contacts the second stop surface to conduct at least a part of the impact load directly into the chassis frame. Thus, a part of the impact load is reduced by the deformation of the elastic elements (and also by the, much lower, deformation of the lemniscate links) until the maximum operating load, whereas the part of the force exceeding this maximum operating load is introduced directly into the corresponding cross arm.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For a further explanation of the invention, the following part of the description refers to the FIGURES from which further advantageous embodiments, details and developments of the invention can be derived. The FIGURES should be understood as exemplary and, although they explain the concept of the invention, they do not restrict it in any way or even reproduce it in a definitive manner, in which:

The FIGURE shows an embodiment of a chassis frame with a device for force transfer in accordance with the invention.

DETAILED DESCRIPTION OF THE EXEMPLARY EMBODIMENTS

The FIGURE shows a first cross arm 2 and a second cross arm 3 of a chassis frame 1, where the longitudinal members of the chassis frame 1 connecting the two cross arms 2,3 are not depicted. Herein, the cross arms 2,3 extend parallel to a transverse direction 17 of the chassis frame 1 and are aligned symmetrically to a longitudinal direction 16 standing normal to the transverse direction 17. Here, the device for force transfer in accordance with the invention between the chassis frame 1 and a carriage body comprises a first lemniscate link 4 and a second lemniscate link 5 plus a yoke 10 with a middle linking point 11.

The first lemniscate link 4 comprises a first joint 6 and a second joint 8 and is connected via the first joint 6 to the first cross arm 2 and via the second joint 8 to the yoke 10. Similarly, the second lemniscate link 5 also comprises a first joint 7 and a second joint 9, where the second lemniscate link 5 is connected via the first link 7 to the second cross arm 3 and via the second joint 9 to the yoke 10.

On the one hand, the distance between the first 6 and second joint 8 of the first lemniscate link 4 (with the second lemniscate link 5, i.e., the same distance is established between the first 7 and second joint 8) is greater than the distance between the second joints 8,9 of the two lemniscate links 4,5. On the other hand, the lemniscate links 4,5 are aligned parallel to the longitudinal direction 16 and offset with respect to one another relative to the transverse direction 17. As a result, a Z-shaped assembly of the lemniscate links 4,5 and the yoke 10 becomes formed. Herein, viewed in the longitudinal direction 16, the middle linking point 11 is located in the middle between the two cross arms 2,3 and, viewed in the transverse direction 17, in the middle between the two lemniscate links 4,5. A pivot pin 12 of a carriage body is mounted in the yoke 10, where the longitudinal axis of the pivot pin 12 passes through the middle linking point 11 and extends parallel to a vertical direction, where the vertical direction is defined by the normal vector of the longitudinal direction 16 and the transverse direction 17.

In the present case, the first joints 6,7 are formed as spherical bearings so that they can both be swiveled about an axis parallel to the transverse direction 17 and about an axis parallel to the vertical direction. However, the function of the lemniscate linkage is also achieved if the first joints 6,7 can only be swiveled about the axis parallel to the vertical direction parallel. The second joints 8,9 are constructed similarly, where again only the swivel axis parallel to the vertical direction is absolutely necessary.

If, for example, due to cornering, a transverse force is now exerted on the carriage body, then the lemniscate links 4,5 on the first joints 6,7 are swiveled about the swivel axes parallel to the vertical direction so that the middle linking point 11, and hence the pivot pin 12, moves on a lemniscate that is selected such that the movement approximately corresponds to a straight movement parallel to the transverse direction 17. It is self-evident that, in such a deflected state, the lemniscate links 4,5 are no longer parallel to one another.

In addition to any transverse forces that occur, a tractive force acting on the chassis frame 1 in a tractive force direction 15, which in the example shown, extends parallel to the longitudinal direction 16, must also be transferred between the chassis frame 1 and carriage body or pivot pin 12 of the carriage body. Under the operating load, the tractive force is transferred via the lemniscate links 4,5 and the yoke 10 to the pivot pin 12. Herein, any impacts under the operating load, which occur, for example, on acceleration or braking, are reduced, absorbed and damped, on the one hand, by elastic deformation of the actual lemniscate links 4,5 and, on the other, by the deformation of elastically deformable elements 13, which are arranged in all joints 6,7,8,9 and between the yoke 10 and pivot pin 12. Suitable elastic elements 13 are, for example, rubber bushings or rubber-metal bushings. An impact of this kind and the deformations resulting therefrom cause the middle linking point to be displaced in the tractive force direction 15.

In order to now limit this displacement in the tractive force direction 15, limiting means 14 in the form of a first emergency stop 18 and a second emergency stop 19 are provided. Herein, the first emergency stop 18 is arranged on the first cross arm 2 and the second emergency stop 19 on the second cross arm 3 or the emergency stops 18,19 are formed directly by the cross arms 2,3. In detail, the emergency stops 18,19 are formed by projecting extensions of the cross arms 2,3, which each extend in the direction of the yoke 10 or in the direction of the middle linking point 11, where these can, for example, be reinforced by reinforcing plates to increase the rigidity of the emergency stops 18,19. In alternative embodiments, the emergency stops 18,19 can also be connected to the cross arms 2,3 and, for example, be formed as consoles or stacked boxes connected to the cross arms 2,3 in either a non-positive manner or in a positive manner, such as screwed or welded.

The first emergency stop 18 comprises, on the side facing the yoke 10, a first stop surface 20, where the yoke 10 forms a first contact surface 22 on the side facing the first emergency stop 18. Similarly, the second emergency stop 19 comprises on the side facing the yoke 10, a second stop surface 21. Likewise, the yoke 10 forms a second contact surface 23 on the side facing the second emergency stop 19. Here, the contact surfaces 22,23 and the stop surfaces 20,21 are aligned in the transverse direction 17 symmetrically to the cross arms 2,3, lie opposite to one another and form a common projection surface when viewed in the longitudinal direction 16. In order to form the contact surfaces 22,23, sections of the jacket surface of the yoke 10 comprise flat regions parallel to the transverse direction 17, which can be identified in the FIGURE as straight sections of the circumference of the yoke 10.

In the present exemplary embodiment, the contact surfaces 22,23 and the stop surfaces 20,21 are embodied flat, where they self-evidently also extend in a vertical direction.

In other embodiments (not depicted), the contact surfaces 22,23 and/or the stop surfaces 20,21 can also be curved. Here, it is advantageous for the curvature to be formed by a cylinder jacket surface so that arched upper and lower covering curves are connected by straight lines extending parallel to the vertical direction. In particular, it is advantageous here for the covering curves to be embodied as circular arcs, where either the stop surfaces 20,21 or the contact surfaces 22,23 are concave and the other surfaces are each convex so that the surfaces can be in contact regardless of the tractive force direction 15 without thereby becoming skewed.

In order to ensure tractive force transfer under operating load without one of the stop surfaces 20,21 touching the respective contact surface 22,23, a first distance 24 is formed between the first stop surface 20 and the first contact surface 22 and a second distance 25 is formed between the second stop surface 21 and the second contact surface 23. Here, in this specific exemplary embodiment, in the unloaded state, the distances 24,25 are approximately 5 mm. Therefore, if the device is exposed to a tractive load or an impact within the operating load, as described above, this is to a large extent absorbed by the elastic elements 13. However, in the case of an impact load, such as a buffer impact, the operating load is exceeded and the deformation paths of the elastic elements 13 are so great that the first distance 24 (or the second distance 25) is completely cancelled out such that one of the stop surfaces 20,21 touches or is pressed again the respective contact surface 22,23. Hence, the part of the impact load that exceeds the maximum operating load is introduced directly into the chassis frame 1 via the corresponding cross arms 2,3. The emergency stops 18,19 are significantly more rigid than the elastic elements 13. As a result, this substantially prevents further deformation of the elastic elements 13.

This ensures that the elastic elements 13, and the lemniscate links 4,5 or the joints 6,7,8,9 thereof, do not have to be over-dimensioned in order so as to also absorb the entire impact load. Thus, the smaller dimensions of the components enable the weight of the device to be reduced and it is simultaneously possible for the elastic elements 13 to be designed with a lower rigidity in order to be able to damp impacts under operating load more effectively.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device for force transfer between a chassis frame and a carriage body of a rail vehicle, comprising:

first joints;

second joints;

a plurality of lemniscate links connected to the chassis frame via the first joints;

a yoke having a middle linking point in which a pivot pin of the carriage body is mountable, the plurality of lemniscate links being connected to the yoke via the second joints and forming a Z-shaped assembly;

elastically deformable elements arranged within the yoke and the first and second joints and in the yoke; and limiting means for limiting a maximum deflection of the middle linking point of the yoke in a tractive force direction parallel to a tractive force acting on the chassis frame.

2. The device as claimed in claim 1, wherein the first joints of the plurality of lemniscate links are each attached to a cross arm of the chassis frame; and wherein the limiting means comprises a first emergency stop and second emergency stop which are arranged on the cross arms.

3. The device as claimed in claim 2, wherein the yoke is arranged between the cross arms.

4. The device as claimed in claim 3, wherein the yoke is arranged between the cross arms in at least one of (i) symmetrically in a longitudinal direction and (ii) a transverse direction.

5. The device as claimed in claim 3, wherein the emergency stops are connected to the cross arms.

6. The device as claimed in claim 3, wherein the first and second emergency stops are formed by the cross arms.

7. The device as claimed in claim 2, wherein the emergency stops are connected to the cross arms.

8. The device as claimed in claim 2, wherein the first and second emergency stops are formed by the cross arms.

9. The device as claimed in claim 2, wherein the first emergency stop comprises a first stop surface for a first contact surface of the yoke; and wherein the second emergency stop comprises a second stop surface for a second contact surface of the yoke.

10. The device as claimed in claim 9, wherein the first stop surface and the second stop surface are disposed opposite to one another and the yoke is arranged in a longitudinal direction in a midpoint between the first and second stop surfaces.

11. The device as claimed in claim 10, wherein the yoke comprises a first contact surface and a second contact surface, the first and second contact surfaces facing respective stop surfaces.

12. The device as claimed in claim 9, wherein the yoke comprises a first contact surface and a second contact surface, the first and second contact surfaces facing respective stop surfaces.

13. The device as claimed in claim 9, wherein at least one of (i) the first and second contact surfaces and (ii) the first and second stop surfaces are flat.

14. The device as claimed in claim 9, wherein at least one of (i) the first and second contact surfaces and (ii) the first and second stop surfaces have a bent shaped.

15. The device as claimed claim 14, wherein the first and second contact surfaces and the first and second stop surfaces are bent into a cylinder-jacket shape.

16. The device as claimed in claim 9, wherein the first and second contact surfaces and the first and second stop surfaces are spaced apart from one another.

17. The device as claimed in claim 16, wherein a first distance is established between the first stop surface and the first contact surface, said first distance corresponding at least to a deformation path of whichever elastic element is least rigid under an operating load.

18. The device as claimed in claim 16, wherein a second distance is established between the second stop surface and the second contact surface, said second distance corresponding at least to a deformation path of whichever elastic element is least rigid under an operating load.

19. The device as claimed in claim 16, wherein, on an impact load in the tractive force direction that is higher than an operating load, the elastically deformable elements in one of (i) the first and second joints and (ii) the yoke are deformed elastically such that one of (i) the first contact surface contacts the first stop surface and (ii) the second contact surface contacts the second stop surface to conduct at least a part of the impact load directly into the chassis frame.

* * * * *